United States Patent [19]

Przezdziecki

[11] Patent Number: 4,886,739

[45] Date of Patent: Dec. 12, 1989

[54] THERMALLY PROCESSABLE IMAGING ELEMENT AND PROCESS

[75] Inventor: Wojciech M. Przezdziecki, Pittsford, N.Y.

[73] Assignee: Eastman Kodak Company, Rochester, N.Y.

[21] Appl. No.: 230,643

[22] Filed: Aug. 10, 1988

[51] Int. Cl.[4] ..... G03C 1/02

[52] U.S. Cl. ..... 430/617; 430/353; 430/495; 430/531; 430/612; 430/614; 430/627; 430/964; 428/447

[58] Field of Search ..... 430/353, 495, 531, 614, 430/617, 627, 964, 612; 428/447

[56] References Cited

U.S. PATENT DOCUMENTS

| | | | |
|---|---|---|---|
| 3,031,329 | 4/1962 | Wingert | 430/964 |
| 3,080,254 | 3/1963 | Grant, Jr. | 430/616 |
| 3,457,075 | 7/1969 | Morgan et al. | 430/619 |
| 3,801,321 | 4/1974 | Evans et al. | 430/448 |
| 3,933,508 | 1/1976 | Ohkubo et al. | 430/620 |
| 4,264,725 | 4/1981 | Reeves | 430/619 |
| 4,459,350 | 7/1984 | Przezdziecki | 430/353 |
| 4,582,782 | 4/1986 | Valsecchi | 430/527 |
| 4,741,992 | 5/1988 | Przezdziecki | 430/523 |

OTHER PUBLICATIONS

Research Disclosure, Jun. 1978, Item No. 17029, *Research Disclosure,* vol. 170, Kenneth Mason Publications Ltd., Hampshire, England.

*Primary Examiner*—Paul R. Michl
*Assistant Examiner*—Janet C. Baxter
*Attorney, Agent, or Firm*—Richard E. Knapp

[57] ABSTRACT

In a thermally processable imaging element and process an imaging layer comprising a photothermographic or thermographic imaging composition and 2.5 to 20% by weight of the layer of at least one hydrolyzed polyalkoxysilane (hydrolyzed $Si(OR_1)_4$ or hydrolyzed $R_2$—$Si(OR_3)_3$) enables increased maximum image density. Such a hydrolyzed polyalkoxysilane in a hydrophobic imaging layer of such an element enables increased adhesion of the imaging layer to a contiguous hydrophobic hydrophilio layer, particularly a hydrophilic overcoat layer.

19 Claims, No Drawings

THERMALLY PROCESSABLE IMAGING ELEMENT AND PROCESS

This invention relates to a thermally processable imaging element comprising an imaging layer comprising a photothermographic or thermographic imaging composition and a concentration of hydrolyzed polyalkoxysilane that enables increased speed upon processing and enables increased adhesion of a contiguous layer, such as an overcoat layer. Such an element is useful for thermal processing to form an image.

Thermally processable imaging elements, including films and papers, for producing images by thermal processing are known. These elements include photothermographic elements in which an image is formed by imagewise exposure of the element to light followed by development by uniformly heating the element. These elements also include thermographic elements in which a image is formed by imagewise heating the element. Such elements are described in, for example, *Research Disclosure,* June 1978; Item No. 17029 and U.S. Pat. Nos. 3,457,075; 3,933,508; 4,741,992 and 3,080,254.

A problem that has been exhibited by thermally processable imaging elements comprising imaging layers that are hydrophobic, particularly those that comprise a hydrophobic binder such as poly(vinyl butyral), and a hydrophilic overcoat, is that the overcoat is in some cases not as adhesive to the imaging layer during thermal processing as required. This is illustrated in the following comparative examples with an overcoat that is particularly useful for thermally processable elements as described in U.S. Pat. No. 4,741,992. This overcoat comprises poly(silicic acid) and a compatible hydrophilic polymer, such as poly(vinyl alcohol).

A continuing need has existed to provide an addenda for the imaging layer of the thermally processable elements that enables improved adhesion of a contiguous layer, particularly a contiguous hydrophilic layer, when the imaging layer is hydrophobic, such as when the imaging layer comprises a poly(vinyl butyral) binder. The requirements for such an addenda are stringent because the resulting imaging layer with the addenda must not only enable increased adhesion of the contiguous layer but also the addenda must not adversely affect the imaging properties of the imaging layer, such as the sensitometric properties of a photothermographic imaging layer, at thermal processing temperatures.

It has been been found that the described requirements are satisfied by a thermally processable imaging element, particularly a photothermographic or thermographic element, comprising a support bearing at least one photothermographic or thermographic imaging layer comprising a photothermographic or thermographic imaging composition and 2.5 to 20% by weight of the imaging layer of at least one hydrolyzed polyalkoxysilane. An illustrative polyalkoxysilane is represented by the formula $Si(OR_1)_4$ or $R_2—Si(OR_3)_3$ wherein $R_1$ and $R_3$ are individually unsubstituted or substituted alkyl containing 1 to 4 carbon atoms, such as methyl, ethyl, propyl and butyl, and $R_2$ is unsubstituted or substituted alkyl, such as alkyl containing 1 to 22 carbon atoms, such as methyl, ethyl, propyl, butyl, and N-octadecyl; or unsubstituted or substituted phenyl. Such a hydrolyzed polyalkoxysilane not only enables increases adhesion of a contiguous layer, particularly an overcoat layer, but also surprisingly enables increased photographic speed. This is demonstrated in the following comparative examples.

The polyalkoxysilane can be prepared by methods known in the organic synthesis art. The polyalkoxysilane can be hydrolyzed by methods known in the organic synthesis art also. Preferably the polyalkoxysilane is hydrolyzed in situ in the photothermographic or thermographic imaging composition during or after coating on the support of the element. The term hydrolzyed in situ herein means that the polyalkoxysilane is hydrolyzed in the photothermographic or thermographic imaging composition, preferably after coating the imaging composition on the support of the element.

It is believed that the polyalkoxysilane upon being hydrolyzed forms an $Si(OH)_4$ moiety. When the $Si(OH)_4$ moiety in combination with the binder of the imaging composition is heated with removal of water formed, it is believed that a cross-linking reaction takes place that enables the resulting composition to form a bonded material. It is highly preferred that the binder of the imaging composition have hydroxyl groups that enable the binding reaction between the $Si(OH)_4$ moiety and the binder. It is also preferred that a layer contiguous to the imaging layer comprise a binder that has hydroxyl groups that will enable cross-linking between the imaging layer and the contiguous layer, preferably an overcoat layer. Any binders that have such hydroxyl groups are useful in the imaging layer. A typical binder in the imaging layer that enables such a reaction is poly(vinyl butyral). A typical contiguous layer, for example an overcoat layer, comprises poly(silicic acid) and poly(vinyl alcohol).

The mechanism may be illustrated as follows: (tetraethoxysilane ($Si(OC_2H_5)_4$) is an example of a useful polyalkoxysilane)

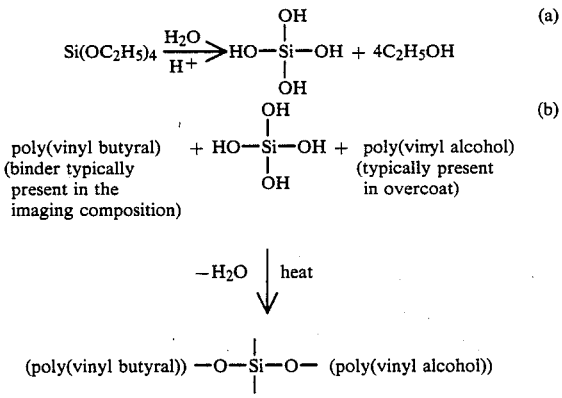

In the case of a polyalkoxysilane of formula $R_2—Si(OR_3)_3$, it is preferred that the $R_2$ group by hydrophobic enabling increased compatibility with a hydrophobic binder in the imaging layer, such as increased compatibility with poly(vinyl butyral). It is believed that the hydrolysis of such a polyoxysilane in situ enables increased adhesion between the imaging layer containing a hydrophobic binder and a polymer containing hydroxyl groups in, for example, a contiguous layer, such as an overcoat layer. For example, hydrolysis and cross-linking can occur during drying at elevated temperatures of the coated element and/or during storage of the element prior to imaging. This is represented by the following reaction:

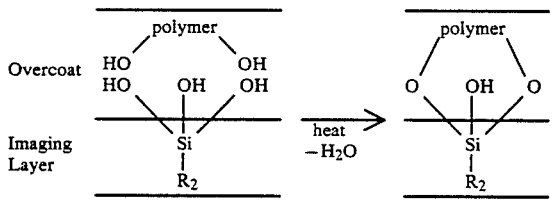

A useful hyrolyzed polyoxysilane in the imaging layer does not adversely flow, smear or distort the imaging layer or a contiguous layer, such as an overcoat layer, at processing temperature, typically within the range of 100° C. to 200° C.

The optimum concentration of polyoxysilane added to the imaging composition prior to hydrolyzing the polyoxysilane will vary depending upon the components in the imaging composition, coating conditions, the particular contiguous layer, such as the particular overcoat layer and hydrolyzing conditions. Typically 5 to 25% of polyoxysilane is added to the imaging composition prior to coating the composition on the support. The optimum concentration of polyoxysilane in the imaging layer will also vary depending upon the described factors. Typically the concentration of polyoxysilane is within the range of 5 to 25% by weight of the imaging layer, preferably within the range of 10 to 20% by weight of the imaging layer.

The polyalkoxysilane is useful in any thermally processable imaging element, particularly any photothermographic element or thermographic element, that is compatible with the polyalkoxysilane. The thermally processable element can be a black and white imaging element or a dye-forming thermally processable imaging element. The polyalkoxysilane is particularly useful in a silver halide photothermographic element designed for dry physical development. Illustrative useful photothermographic elements include those described in, for example, U.S. Pat. Nos. 3,457,075; 4,459,350; 4,264,725; 4,741,992 and *Research Disclosure,* June 1978, Item No. 17029. The polyalkoxysilane is particularly useful in, for example, at least one imaging layer of a silver halide photothermographic element comprising a support bearing, in reactive association, in a binder, preferably a binder comprising hyroxyl groups, (a) photographic silver halide, prepared in situ and/or ex situ, (b) an image forming combination comprising (i) an organic silver salt oxidizing agent, preferably a silver salt of a long chain fatty acid, such as silver behenate, with (ii) a reducing agent for the organic silver salt oxidizing agent, preferably a phenolic reducing agent, an (c) an optional toning agent.

Examples of useful polyoxysilane are as follows:

$Si(OC_2H_5)_4$, $Si(OCH_3)_4$, $C_6H_5Si(OC_2H_5)_3$, $C_6H_5Si(OCH_3)_3$, $NH_2CH_2CH_2CH_2Si(OC_2H_5)_3$, $NH_2CH_2CH_2CH_2Si(OCH_3)_3$,

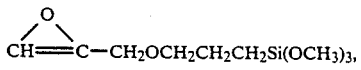

$CH_2OCH_2CH_2CH_2Si(OCH_3)_3$, or $CH_3(CH_2)_{17}Si(OC_2H_5)_3$.

Combinations of polyalkoxysilanes are also useful in the imaging layer of the thermally processable imaging element. Optionally at least one hydrolyzed polyalkoxysilane can be included in an imaging layer of the thermally processable imaging element and at least one hydrolyzed polyalkoxysilane can be present in a contiguous layer, such as in an overcoat layer. The hydrolyzed polyalkoxysilane in the imaging layer can be the same as or different from the hydrolyzed polyalkoxysilane in the overcoat layer.

The thermally processable imaging element preferably comprises at least one overcoat layer. The overcoat layer is preferably applied to the thermally processable element at the time of manufacture of the element. The overcoat preferably comprises at least one polymer that comprises hydroxyl groups that will react with the hydrolysis product of the tetraalkoxysilane in the contiguous imaging layer. This enables increased adhesion between the imaginng layer and the contiguous overcoat layer.

The optimum layer thickness of the imaging layer and any contiguous layer, such as an overcoat layer, depends upon various factors, such as the particular element, processing conditions, thermal processing means, desired image and the particular components of the layers. A particularly useful imaging layer thickness is typically within the range of 1 to 10 microns, preferably 3 to 7 microns. A particularly useful overcoat layer thickness is also typically within the range of 1 to 10 microns, preferably 1 to 3 microns.

Useful overcoat compositions are typically transparent and colorless. If the overcoat is not transparent and colorless, then it is necessary, if the element is a photothermographic element, that it be at least transparent to the wavelength of radiation employed to provide and view the image. The overcoat does not significantly adversely affect the imaging properties of the element, such as the sensitometric properties in the case of a photothermographic element, such as minimum density, maximum density, or photographic speed.

The overcoat composition preferably comprises 50 to 90% by weight of the overcoat of poly(silicic acid) and comprises a water soluble hydroxyl containing polymer or monomer that is compatible with the poly(silicic acid). Such an overcoat composition is described in, for example, U.S. Pat. No. 4,741,992. Examples of water soluble hydroxyl containing polymers are acrylamide polymers, water soluble cellulose derivatives, hydroxy ethyl cellulose, water soluble cellulose acetate, and poly(vinyl alcohol). Partially hydrolyzed poly(vinyl alcohols) are preferred.

Thermally processable imaging elements as described can contain multiple polymer containing layers, such as multiple overcoat layers. For example, the thermally processable imaging element can contain a first overcoat layer comprising a polymer other than poly(silicic acid), such as a cellulose derivative and a second overcoat comprising poly(silicic cid) and poly(vinyl alcohol).

A preferred overcoat comprises 50 to 90% by weight of poly(silicic acid) represented by the formula:

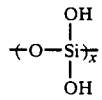

wherein x is an integer within the range of at least 3 to about 600 and wherein the overcoat also comprises 1 to 50;1 % poly(vinyl alcohol).

The photothermographic element comprises a photosensitive component that consists essentially of photographic silver halide. In the photothermographic material it is believed that the latent image silver from the silver halide acts as a catalyst for the described image-forming combination upon processing. A preferred concentration of photographic silver halide is within the range of 0.01 to 10 moles of photographic silver halide per mole of silver behenate in the photothermographic material. Other photosensitive silver salts are useful in combination with the photographic silver halide if desired. Preferred photographic silver halides are silver chloride, silver bromide, silver bromochloride, silver bromoiodide, silver chlorobromoiodide, and mixtures of these silver halides. Very fine grain photographic silver halide is especially useful. The photographic silver halide can be prepared by any of the known procedures in the photographic art. Such procedures for forming photographic silver halides and forms of photographic silver halides are described in, for example, *Research Disclosure,* December 1978, Item No. 17029 and *Research Disclosure,* June 1978, Item No. 17643. Tabular grain photosensitive silver halide is also useful, as described in, for example, U.S. Pat. No. 4,435,499. The photographic silver halide can be unwashed or washed, chemically sensitized, protected against the formation of fog, and stabilized against the loss of sensitivity during keeping as described in the above Research Disclosure publications. The silver halides can be prepared in situ as described in, for example, U.S. Pat. No. 4,457,075, or prepared ex situ by methods known in the photographic art.

The photothermographic element typically comprises an oxidation-reduction image forming combination that contains an organic silver salt oxidizing agent, preferably a silver salt of a long chain fatty acid. Such organic silver salts are resistant to darkening upon illumination. Preferred organic silver salt oxidizing agents are silver salts of long chain fatty acids containing 10 to 30 carbon atoms. Examples of useful organic silver salt oxidizing agents are silver behenate, silver stearate, silver oleate, silver laurate, silver hydroxystearate, silver caprate, silver myristate, and silver palmitate. Combinations of organic silver salt oxidizing agents are also useful. Examples of useful organic silver salt oxidizing agents that are not organic silver salts of fatty acids are silver benzoate and silver benzotriazole.

The optimum concentration of organic silver salt oxidizing agent in the photothermographic element will vary depending upon the desired image, particular organic silver salt oxidizing agent, particular reducing agent and particular photothermographic element. A preferred concentration of organic silver salt oxidizing agent is within the range of 0.1 to 100 moles of organic silver salt oxidizing agent per mole of silver in the element. When combinations of organic silver salt oxidizing agents are present, the total concentration of organic silver salt oxidizing agents is preferably within the described concentration range.

A variety of reducing agents are useful in the photothermographic element. Examples of useful reducing agents in the image forming combination include substituted phenols and naphthols, such as bis-beta-naphthols; a polyhydroxybenzenes, such as hydroquinones, pyrogallois and catechols; aminophenols, such as 2,4;l-diaminophenols and methylaminophenols; ascorbic acid reducing agents, such as ascorbic acid, ascorbic acid ketals and other ascorbic acid derivatives; hydroxylamine reducing agents; 3-pyrazolidone reducing agents, such as 1-phenyl-3-pyrazolidone and 4-methyl-4-hydroxymethyl-1-phenyl-pyrazolidone; and sulfonamidophenols and other organic reducing agents known to be useful in photothermographic elements, such as described in U.S. Pat. No. 3,933,508, U.S. Pat. No. 3,8801,321 and *Research Disclosure,* June 1978, Item No. 17029. Combinations of organic reducing agents are also useful in the photothermographic element.

Preferred organic reducing agents in the photothermographic element are sulfonamidophenol reducing agents, such as described in U.S. Pat. No. 3,801,381. Examples of useful sulfonamidophenol reducing agents are 2,6-dichloro-4-benzenesulphonamidophenol; benzenesulphonamidophenol; and 2,6-dibromo-4-benzenesulphonamidophenol, and combinations thereof.

An optimum concentration of organic reducing agent in the photothermographic element varies depending upon such factors as the particular photothermographic element, desired image, processing conditions, the particular organic silver salt oxidizing agent, and the particular polyalkoxysilane.

The photothermographic element preferably comprises a toning agent, also known as an activator-toner or toner-accelerator. Combinations of toning agents are also useful in the photothermographic element. Examples of useful toning agents and toning agent combinations are described in, for example, *Research Disclosure,* June 1978, Item No. 17029 and U.S. Pat. No. 4,123,282. Examples of useful toning agents include, for example, phthalimide, N-hydroxyphthalimide, N-potassium-phthalimide, succinimide, N-hydroxy-1,8-naphthalimide, phthalazine, 1-(2H)-phthalazinone and 2-acetylphthalazinone.

Post-processing image stabilizers and latent image keeping stabilizers are useful in the photothermographic element. Any of the stabilizers known in the photohermographic art are useful for the described photothermographic element. Illustrative examples of useful stabilizers include photolytically active stabilizers and stabilizer precursors as described in, for example, U.S. Pat. No. 4,459,350. Other examples of useful stabilizers include azole thioethers and blocked azolinethione stabilizer precursors and carbamoyl stabilizer precursors, such as described in U.S. Pat. No. 3,877,940.

The thermally processable elements as described preferably contain various colloids and polymers alone or in combination as vehicles and binders and in various layers. Useful materials are hydrophilic or hydrophobic. They are transparent or translucent and include both naturally occurring substances, such as gelatin, gelatin derivatives, cellulose derivatives, polysaccharides, such as dextran, gum arabic and the like; and synthetic polymeric substances, such as water-soluble polyvinyl compounds like poly(vinylpyrrolidone) and acrylamide polymers. Other synthetic polymeric compounds that are useful include dispersed vinyl compounds such as in latex form and particularly those that increase dimensional stability of photographic elements. Effective polymers include water insoluble polymers of acrylates, such as alkylacrylates and methacrylates, acrylic acid, sulfoacrylates, and those that have cross-linking sites. Preferred high molecular weight materials and resins include poly(vinyl butyral), cellulose acetate butyrate, poly(methylmethacrylate), poly(vinylpyrrolidone), ethyl cellulose, polystyrene, poly(vinylchloride), chlorinated rubbers, polyisobutylene, butadienestyrene copolymers, copolymers of vinyl chloride and vinyl acetate, copolymers of vinylidene chloride and vinyl acetate, poly(vinyl alcohol) and polycarbonates.

Photothermographic elements and thermographic elements as described can contain addenda that are known to aid in formation of a useful image. The photothermographic element can contain development modifiers that function as speed increasing compounds, sensitizing dyes, hardeners, antistatic agents, plasticizers and lubricants, coating aids, brighteners, absorbing and filter dyes, such as described in *Research Disclosure,* December 1978, Item No. 17643 and *Research Disclosure,* June 1978, Item No. 17092.

The thermally processable element can comprise a variety of supports. Examples of useful supports are poly(vinylacetal) film, polystyrene film, poly(ethyleneterephthalate) film, polycarbonate film, and related films and resinous materials, as well as paper, glass, metal, and other supports that withstand the thermal processing temperatures.

The layers of the thermally processable element are coated on a support by coating procedures known in the photographic art, including dip coating, air knife coating, curtain coating or extrusion coating using hoppers. If desired, two or more layers are coated simultaneously. Also, if desired hydrolysis of the polyoxyalkylsilane can be carried out during the coatinng procedure.

Spectral sensitizing dyes are useful in the photothermographic element to confer added sensitivity to the element. Useful sensitizing dyes are described in, for example, *Research Disclosure,* June 1978, Item No. 17029 and *Research Disclosure,* December 1978, Item No. 17643.

A photothermographic element as described preferably comprises a thermal stabilizer to help stabilize the photothermographic element prior to exposure and processing. Such a thermal stabilizer provides improved stability of the photothermographic element during storage. Preferred thermal stabilizers are 2-bromo-2-arylsulfonylacetamides, such as 2-bromo-2-p-tolysulfonylacetamide; 2(tribromomethyl sulfonyl)benzothiazole; and 6-substituted-2,4-bis(triboromomethyl)-s-triazines, such as 6-methyl or 6-phenyl-2,4-bis(tribromomethyl)-s-triazine.

The thermally processable elements are exposed by means of various forms of energy. In the case of the photothermographic element such forms of energy include those to which the photographic silver halides are sensitive and include ultraviolet, visible and infrared regions of the electromagnetic spectrum as well as electron beam and beta radiation, gamma ray, x-ray, alpha particle, neutron radiation and other forms of corpuscular wave-like radiant energy in either non-coherent (random phase) and coherent (in phase) forms produced by lasers. Exposures are monochromatic, orthochromatic, or panchromatic depending upon the spectral sensitization of the photographic silver halide. Imagewise exposure is preferably for a time and intensity sufficient to produce a developable latent image in the photothermographic element.

After imagewise exposure of the photothermographic element, the resulting latent image is developed merely by overall heating the element to thermal processing temperature. This overall heating merely involves heating the photothermographic element to a temperature within the range of about 90° C. to 180° C. until a developed image is formed, such as within about 0.5 to about 60 seconds. By increasing or decreasing the thermal processing temperature a shorter or longer time of processing is useful. A preferred thermal processing temperature is within the range of about 100° C. to about 130° C.

In the case of a thermographic element, the thermal energy source and means for imaging can be any imagewise thermal exposure source and means that are known in the thermographic imaging art. The thermographic imaging means can be, for example, an infrared heating means, laser, microwave heating means or the like.

Heating means known in the photothermographic and thermographic imaging art are useful for providing the desired processing temperature for the exposed photothermographic element. The heating means is, for example, a simple hot plate, iron, roller, heated drum, microwave heating means, heated air of the like.

Thermal processing is preferably carried out under ambient conditions of pressure and humidity. Conditions outside of normal atmospheric pressure and humidity are useful.

The components of the thermally processable element can be in any location in the element that provides the desired image. If desired, one or more of the components can be in one or more layers of the element. For example, in some cases, it is desirable to include certain percentages of the reducing agent, toner, stabilizer and/or other addenda in the overcoat layer over the photothermographic imaging layer of the element. This, in some cases, reduces migration of certain addenda in the layers of the element.

It is necessary that the components of the imaging combination be "in association" with each other in order to produce the desired image. The term "in association" herein means that in the photothermographic element the photographic silver halide and the image forming combination are in a location with respect to each other that enables the desired processing and forms a useful image.

Thermographic elements in which the polyalkoxysilanes are useful include any in which the thermographic imaging composition is compatible with the polyalkoxysilane. Such thermographic elements include those described in, for example, U.S. Pat. Nos. 2,663,657; 2,910,377; 3,028,254; 3,031,329 and 3,080,254. An example of a useful thermographic element comprises a support bearing a thermographic layer, preferably a thermographic hydrophobic imaging layer, and a hydrophilic overcoat layer wherein the thermographic imaging layer comprises a thermographic imaging composition and 5 to 25% by weight of the imaging layer of at least one polyalkoxysilane.

The term water soluble herein means that at least 2 grams of the compound or composition dissolves in one liter of water with 2 hours at 90° C.

The following examples further illustrate the invention.

EXAMPLE 1

Addition of TEOS to photothermographic layer

Two film materials were prepared according to the following diagram:

| A (Control) | B |
|---|---|
| Overcoat | Overcoat |
| Photothermographic Layer | Photothermographic Layer + 1.07 g/m$^2$ of TEOS |

Photothermographic Layer—The photothermographic layers were prepared and coated as follows:

| | g/m² | |
|---|---|---|
| | A | B |
| Silver Behenate (Ag) | 0.861 | 0.861 |
| $HgBr_2$(Hg) | 0.001 | 0.001 |
| AgBr (Ag) | 0.43 | 0.43 |
| Na I | 0.038 | 0.038 |
| Succinimide (toner/development modified) | 0.452 | 0.02 |
| Surfactant (SF-96 which is a polysiloxane fluid and is available from and a trademark of General Electric Co., U.S.A. | 0.02 | 0.02 |
| Monobromo stabilizer: | 0.065 | 0.065 |

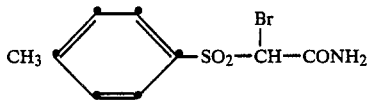

| | | |
|---|---|---|
| 2,4-bis(trichloromethyl)-6-(1-naptho)-s-triazine (stabilizer as described in U.S. Pat. No. 4,459,350) | 0.065 | 0.065 |
| Poly(vinyl butyral) binder (BUTVAR B-76, a trademark of Monsanto Co., U.S.A. | 4.30 | 4.30 |
| $Si(OC_2H_5)_4$ | — | 1.07 |
| Sensitizing dye | 0.005 | 0.005 |
| Benzenesulfonamidophenol (developing agent) | 1.07 | 1.07 |
| Methyl isobutyl ketone (MIBK solvent) | 0.323 | 0.323 |

Evaluation - Adhesion of the PSA/PVA overcoat was measured within two weeks after coating using raw stock and heat processed material:

1.

| | Peel Force (g/1.9 cm) | |
|---|---|---|
| | Raw Stock | Processed |
| A, Control | | |
| B, TEOS at 1.07 g/m² | 27 | 34 |

2. Adhesion of the overcoat (Raw Stock) was re-measured at various intervals of time, showing progressive increase in the peel force:

| | Peel Force (g/1.9 cm) | | |
|---|---|---|---|
| after | 2 Wks. | 2 Mos. | 6 Mos. |
| A, Control | 11 | 10 | 7 |
| B, TEOS at 1.07 g/m² | 27 | 45 | >300 |

This example illustrates the improvement in the adhesion of an aqueous overcoat by incorporation of a polyalkoxysilane in the photothermographic layer.

EXAMPLE 2

TEOS Concentration vs. Peel Force

Series of coatings, containing varying amounts of TEOS in the photothermographic layer were prepared and tested as in Example 1. The results are tabulated as follows:

| | TEOS g/m² | Peel Force (g/1.9 cm) |
|---|---|---|
| A-1 | 0 | 7 |
| A-2 | 0.05 | 9 |
| A-3 | 0.27 | 20 |
| A-4 | 0.54 | 165 |
| B-1 | 0 | 7 |
| B-2 | 1.07 | >300 |
| B-3 | 2.14 | >300 |

These examples illustrate the effects of concentration of TEOS on the adhesion of aqueous PSA/PVA overcoat to the photothermographic layer.

EXAMPLE 3

Effects of TEOS Concentration on the adhesion of gelatin overcoat

Series of coatings, containing varying amounts of TEOS in the photothermographic layer and overcoated with gelatin (0.15 g/m²), were prepared and tested as in Example 1. The results are tabulated as follows:

| | TEOS g/m² | Peel Force (g/1.9 cm) |
|---|---|---|
| A-1 | 0 | 10 |
| A-2 | 0.05 | 10 |
| A-3 | 0.27 | 12 |
| A-4 | 0.54 | 14 |
| B-1 | 0 | 10 |
| B-2 | 2.14 | 59 |

A significant and useful improvement in the gelatin overcoat adhesion is demonstrated.

EXAMPLE 4

Use of organically modified silane-Phenyl-triethoxysilane (PTEOS)

Series of coating, containing varying amounts of PTEOS in the photothermographic layer were prepared and evaluated as in Example 1. The results are tabulated as follows:

| | PTEOS g/m² | Peel Force (g/1.9 cm) |
|---|---|---|
| A | 0 | 9 |
| B | 0.54 | 16 |
| C | 1.07 | 44 |
| D | 2.14 | 105 |

EXAMPLE 5

Effect of TEOS on Photographic Speed

Selected coatings from Example 2 were packaged at 50% R.H. and incubated for 2 weeks at 22° C. (ambient) and 49° C. The coatings were then exposed (10–3, EG&G, Wratten 47 filter), heat processed for 5 seconds at 119° C., and relative speeds recorded as follows:

| TEOS | | Rel. Log Speed | | |
|---|---|---|---|---|
| mg/ft² | g/m² | Ambient | 120° F. | Loss |
| 0 | 0 | 1.31 | 1.11 | 0.20 |
| 50 | 0.54 | 1.35 | 1.20 | 0.15 |
| 100 | 1.08 | 1.38 | 1.25 | 0.13 |
| 200 | 2.16 | 1.41 | 1.30 | 0.11 |

Addition of TEOS to the photothermographic layer results in (a) increase in photographic speed and (b) decrease in the rate of loss of speed at high temperature keeping.

EXAMPLE 6

Addition of TEOS-Improved Keeping

Comparison of incubations was carried out between coatings with and without TEOS in the photothermographic layer. The following sensitometric results were obtained:

| | Dmin | Dmax | Rel. Log Speed | Speed Loss Amb. vs 120° F. |
|---|---|---|---|---|
| 0 mg/ft$^2$ TEOS | | | | |
| Ambient | .14 | 2.9 | 1.21 | |
| 14 days at 100° F., 50% R.H. | .13 | 2.6 | 1.00 | |
| 14 days at 120° F., 50% R.H. | .12 | 2.4 | 0.84 | .37 |
| 200 mg/ft$^2$ (2.16 g/m$^2$) TEOS | | | | |
| Ambient | .16 | 2.8 | 1.31 | |
| 14 days at 100° F., 50% R.H. | .15 | 2.8 | 1.15 | |
| 14 days at 120° F., | .14 | 2.7 | 1.12 | .19 |

A highly preferred photothermographic element as illustrated by these examples comprises a support bearing, in reactive association, in poly(vinyl butyral) binder, an imaging layer comprising:

(a) photographic silver halide, (b) an image forming combination comprising (i) silver behenate, with (ii) a phenolic reducing agent for the silver behenate, such as a sulfonamidophenol reducing agent, (c) a succinimide toning agent, (d) an image stabilizer, (e) 5 to 25% by weight of hydrolyzed tetraethoxysilane, and an overcoat layer comprising 50 to 90% by weight of the overcoat layer of poly(silicic acid) and 1 to 50% by weight of the overcoat layer of poly(vinyl alcohol).

The invention has been described in detail with particular reference to preferred embodiments thereof, but it will be understood that variations and modifications can be effected within the spirit and scope of the invention.

What is claimed is:

1. A photothermographic or thermographic imaging element comprising a support bearing at least one photothermographic or thermographic layer comprising a photothermographic or thermographic imaging composition and 2.5 to 20% by weight of the layer of at least one hydrolyzed polyalkoxysilane.

2. A photothermographic or thermographic element as in claim 1 wherein the hydrolyzed polyalkoxysilane is hydrolyzed $Si(OR_1)_4$ or hydrolyzed $R_2—Si(OR_3)_3$ wherein $R_1$ and $R_3$ are individually unsubstituted or substituted alkyl containing 1 to 4 carbon atoms; and $R_2$ is unsubstituted or substituted alkyl or phenyl.

3. A photothermographic or thermographic element as in claim 1 wherein the imaging layer comprises hydrolyzed $Si(OC_2H_5)_4$, $Si(OCH_3)_4$, $C_6H_5Si(OC_2H_5)_3$, $C_6H_5Si(OCH_3)_3$, $NH_2CH_2CH_2CH_2Si(OC_2H_5)_3$, $NH_2CH_2CH_2CH_2Si(OCH_3)_3$,

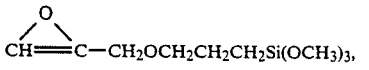

$CH_2OCH_2CH_2CH_2Si(OCH_3)_3$, or $CH_3(CH_2)_{17}Si(OC_2H_5)_3$.

4. A photothermographic or thermographic element as in claim 1 comprising a hydrophilic overcoat layer on the imaging layer.

5. A photothermographic or thermographic element as in claim 1 comprising a hydrophilic overcoat layer comprising 50 to 90% by weight poly(silicic acid) and comprising in the overcaot layer, a water soluble hydroxyl containing polymer or monomer that is compatible with poly(silicic acid).

6. A photothermographic or thermographic element as in claim 1 comprising an overcoat layer comprising 50 to 90% by weight poly(silicic acid) represented by the formula:

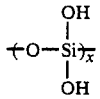

wherein x is n integer within the range of at least 3 to about 600 and wherein the overcoat comprises 1 to 50% by weight poly(vinyl alcohol).

7. A photothermographic or thermographic element as in claim 1 wherein the imaging layer comprises a poly(vinyl butyral) binder.

8. A photothermographic or thermographic element as in claim 1 wherein the imaging composition comprises an image-forming combination comprising (i) an organic silver salt oxidizing agent, with (ii) a reducing agent for the organic silver salt oxidizing agent.

9. A photothermographic element comprising a support bearing in reactive association, in a hydrophobic binder, an imaging layer comprising:

(a) photographic silver halide, (b) an image forming combination comprising (i) an organic silver salt oxidizing agent, with (ii) a reducing agent for the organic silver salt oxidizing agent, (c) a toning agent, and (d) 2.5 to 20% by weight of the imaging layer of at least one hydrolyzed polyalkoxysilane, and a hydrophilic overcoat layer.

10. A photothermographic element as in claim 9 wherein the hydrolyzed polyalkoxysilane is hydrolyzed $Si(OC_2H_5)_4$.

11. A photothermographic element as in claim 9 comprising a support bearing in reactive association, in a poly(vinyl butyral) binder, an imaging layer comprising:

(a) photographic silver halide, (b) an image forming combination comprising (i) silver behenate, with (ii) a phenolic reducing agent for the silver behenate, (c) a succinimide toning agent, (d) an image stabilizer, (e) 2.5 to 20% by weight of hydrolyzed $Si(OC_2H_5)_4$, and an overcoat layer comprising 50 to 90% by weight poly(silicic acid) represented by the formula:

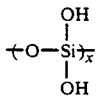

wherein x is an integer within the range of at least 3 to about 600 and wherein the overcoat also comprises 1 to 50% poly(vinyl alcohol).

12. A thermographic element comprising a support bearing a thermographic hydrophobic imaging layer and a hydrophilic overcoat layer wherein the imaging layer comprises a thermographic imaging composition and 2.5 to 20% by weight of said imaging layer of at least one hydrolyzed polyalkoxysilane.

13. A thermographic element as in claim 12 wherein the hydrolyzed polyalkoxysilane is hydrolyzed $Si(OC_2H_5)_4$.

14. A method of forming an image in an exposed photothermographic element as defined in claim 1 said method comprising heating the element to a temperature within the range of 90° C. to 150° C. until the image is formed.

15. A method of forming an image as in claim 14 comprising heating the element to a temperature within the range of 100° C. to 130° C. for 0.5 to 60 seconds until the image is formed.

16. A method of forming an image in an exposed photothermographic element as defined in claim 11 comprising heating the element to a temperature within the range of 100° C. to 130° C. for 0.5 to 60 seconds until the image is formed.

17. In a method of preparing a photothermographic or thermographic imaging element comprising a support bearing at least one photothermographic or thermographic imaging layer comprising a photothermographic or thermographic imaging composition and 2.5 to 20% by weight of at least one hydrolyzed polyalkoxysilane, comprising the steps of preparing a photothermographic or thermographic composition and coating the resulting composition on a support, the steps comprising (A) mixing 5 to 25% by weight of the photothermographic or thermographic composition of a polyalkoxysilane into the photothermographic or thermographic composition; and (B) hydrolyzing the polyalkoxysilane in the photothermographic or thermographic composition during or after coating the photothermographic or thermographic composition on the support.

18. A method as in claim 17 wherein a hydrophilic overcoat composition is coated on the photothermographic or thermographic imaging layer.

19. A method as in claim 17 wherein the polyalkoxysilane is $Si(OC_2H_5)_4$.

* * * * *

UNITED STATES PATENT AND TRADEMARK OFFICE

CERTIFICATE OF CORRECTION

PATENT NO. : 4,886,739

DATED : December 12, 1989

INVENTOR(S) : W. M. Przezdziecki

It is certified that error appears in the above-identified patent and that said Letters Patent is hereby corrected as shown below:

Abstract, line 9, "hydrophobic" should be deleted.

Abstract, line 10, "hydrophilic" should be --hydrophilic--.

Delete col. 3, line 63 (repeated from col. 3, line 61).

Col. 5, lines 65-66, "2,4;1-diaminophenols" should be --2,4-diaminophenols--.

Col. 6, line 7, "3,8801,321" should be --3,801,321--.

Col. 7, line 26, "coatinng" should be --coating--.

Col. 8, line 15, "of" should be --or--.

Delete col. 11, line 61 (repeated from col. 11, line 59).

Signed and Sealed this

Twentieth Day of August, 1991

*Attest:*

*Attesting Officer*

HARRY F. MANBECK, JR.

*Commissioner of Patents and Trademarks*